US011399247B2

(12) United States Patent
French

(10) Patent No.: US 11,399,247 B2
(45) Date of Patent: Jul. 26, 2022

(54) SYSTEM AND METHOD FOR PROVIDING ADVANCED LOUDSPEAKER PROTECTION WITH OVER-EXCURSION, FREQUENCY COMPENSATION AND NON-LINEAR CORRECTION

(71) Applicant: Harman International Industries, Incorporated, Stamford, CT (US)

(72) Inventor: John Barry French, Port Carling (CA)

(73) Assignee: Harman International Industries, Incorporated, Stamford, CT (US)

( * ) Notice: Subject to any disclaimer, the term of this patent is extended or adjusted under 35 U.S.C. 154(b) by 23 days.

(21) Appl. No.: 17/135,430

(22) Filed: Dec. 28, 2020

(65) Prior Publication Data

US 2021/0204081 A1 Jul. 1, 2021

Related U.S. Application Data

(60) Provisional application No. 62/955,138, filed on Dec. 30, 2019.

(51) Int. Cl.
*H04R 29/00* (2006.01)
*H04R 3/02* (2006.01)

(52) U.S. Cl.
CPC ..... *H04R 29/003* (2013.01); *H04R 3/02* (2013.01)

(58) Field of Classification Search
CPC ..... H04R 29/003; H04R 3/02
See application file for complete search history.

(56) References Cited

U.S. PATENT DOCUMENTS 10,667,040 B1 5/2020 French
2014/0064502 A1 3/2014 Hoang Co Thuy
(Continued)

FOREIGN PATENT DOCUMENTS

EP 2538699 A1 12/2012
EP 3734994 A1 11/2020
WO 2017187169 A1 11/2017
(Continued)

OTHER PUBLICATIONS

European Search Report for Application No. 20217736.6 dated May 6, 2021, 8 pgs.
(Continued)

*Primary Examiner* — Mark Fischer
(74) *Attorney, Agent, or Firm* — Brooks Kushman P.C.

(57) ABSTRACT

In at least one embodiment, an audio amplifier system is provided. The system includes a loudspeaker and an audio amplifier. The loudspeaker transmits an audio output into a listening environment. The audio amplifier is programmed to receive an audio input signal and to generate an excursion signal corresponding to a first excursion level of the voice coil based on the audio input signal. The audio amplifier is further programmed to limit the excursion signal to reach a maximum excursion level and to determine a target pressure for an enclosure of the loudspeaker based on the maximum excursion level. The audio amplifier is further programmed to generate a target current signal based at least on the target pressure and to convert the target current signal into a target voltage signal to a target driving signal to drive the voice coil to reach the maximum excursion level.

20 Claims, 8 Drawing Sheets

(56) References Cited

U.S. PATENT DOCUMENTS

| | | | | |
|---|---|---|---|---|
| 2016/0173983 | A1 | 6/2016 | Berthelsen et al. | |
| 2019/0222939 | A1* | 7/2019 | Brunet | H04R 1/2834 |

FOREIGN PATENT DOCUMENTS

| | | | |
|---|---|---|---|
| WO | 2017202460 | A1 | 11/2017 |
| WO | 2019143150 | A1 | 7/2019 |

OTHER PUBLICATIONS

Partial European Search Report for Application No. 20217588.1 dated May 19, 2021, 14 pgs.
Bright, A., "Active control of loudspeakers: An investigation of practical applications", Jan. 1, 2002, 204 pgs.
Maximilian, M., "Group delay and phase delay example", Jul. 26, 2018, 6 pgs.

* cited by examiner

SYSTEM AND METHOD FOR PROVIDING ADVANCED LOUDSPEAKER PROTECTION WITH OVER-EXCURSION, FREQUENCY COMPENSATION AND NON-LINEAR CORRECTION

CROSS-REFERENCE TO RELATED APPLICATIONS

This application claims the benefit of U.S. provisional application Ser. No. 62/955,138 filed Dec. 30, 2019, the disclosure of which is hereby incorporated in its entirety by reference herein.

This application generally relates to the U.S. application Ser. No. 62/955,125 filed Dec. 30, 2019, entitled "SYSTEM AND METHOD FOR ADAPTIVE CONTROL OF ONLINE EXTRACTION OF LOUDSPEAKER PARAMETERS" the disclosure of which is hereby incorporated in its entirety by reference herein.

TECHNICAL FIELD

One or more aspects disclosed herein generally related to a system and method for providing advanced loudspeaker protection with over-excursion, frequency compensation, and non linear correction. For example, the aspects disclosed herein may correspond but not limited to combined precision over-excursion compression and limiting, frequency compensation, and non linear correction for passive radiator, vented, closed box or infinite baffle moving coil acoustic transducer speakers. These may be suitable for systems that are independent of a look-ahead implementation such as active noise cancellation (ANC) and may be suitable or implemented for adaptive or auto-tuning for use with various amplifier topologies. These aspects and others will be discussed in more detail below.

BACKGROUND

U.S. Pat. No. 10,667,040 ("the '040 patent") to French provides an audio amplifier system that includes memory and an audio amplifier. The audio amplifier includes the memory and is programmed to receive an audio input signal and to generate a target current signal based on the audio input signal and a velocity of a diaphragm of a loudspeaker. The audio amplifier is further programmed to generate a corrected current signal based at least on the target current signal and on a predicted position of a voice coil of the loudspeaker and to determine the predicted position of the voice coil of the loudspeaker based on a flux density value. The flux density value corresponds to a product of magnetic flux of an air gap for the voice coil in the loudspeaker and a length of a voice coil wire in the loudspeaker.

SUMMARY

In at least one embodiment, an audio amplifier system is provided. The system includes a loudspeaker and an audio amplifier. The loudspeaker includes a voice coil for generating an audio output into a listening environment. The audio amplifier is operably coupled to the loudspeaker and is programmed to receive an audio input signal and to generate an excursion signal corresponding to a first excursion level of the voice coil based on the audio input signal. The audio amplifier is further programmed to limit the excursion signal to reach a maximum excursion level and to determine a target pressure for an enclosure of the loudspeaker based on the maximum excursion level. The audio amplifier is further programmed to generate a target current signal based at least on the target pressure and to convert the target current signal into a target voltage signal to a target driving signal to drive the voice coil to reach the maximum excursion level.

In at least another embodiment, a computer-program product embodied in a non-transitory computer read-able medium that is programmed for protecting a loudspeaker is provided. The computer-program product includes instructions for receiving an audio input signal and generating an excursion signal corresponding to a first excursion level of the voice coil based on the audio input signal. The computer-program product further includes instructions for limiting the excursion signal to reach a maximum excursion level and determining a target pressure for an enclosure of the loudspeaker based on the maximum excursion level. The computer-program product further includes instructions for generating a target current signal based at least on the target pressure; and converting the target current signal into a target voltage signal to a target driving signal to drive the voice coil to reach the maximum excursion level.

In at least one embodiment a method for protecting a loudspeaker is provided. The method includes receiving an audio input signal and generating an excursion signal corresponding to a first excursion level of the voice coil based on the audio input signal. The method further includes limiting the excursion signal to reach a maximum excursion level and determining a target pressure for an enclosure of the loudspeaker based on the maximum excursion level. The method further includes generating a target current signal based at least on the target pressure and converting the target current signal into a target voltage signal to a target driving signal to drive the voice coil to reach the maximum excursion level.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

Figure 1:
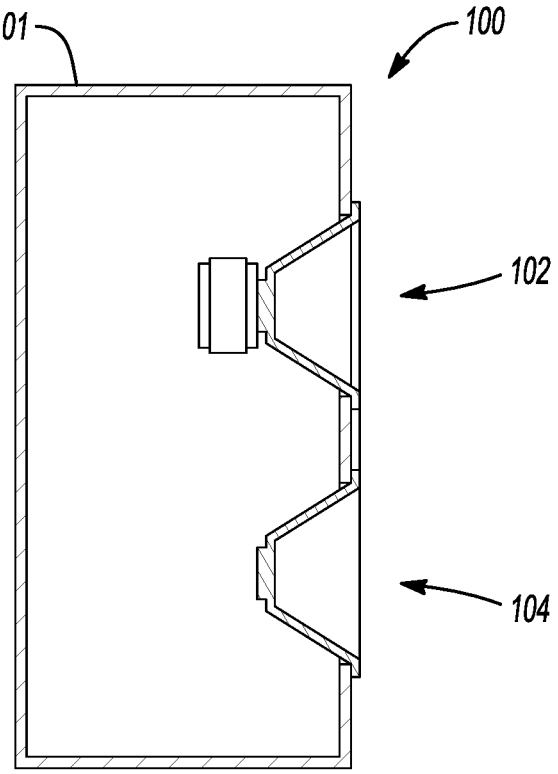
FIG. 1 generally depicts an example of an enclosed loudspeaker system.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

It is recognized that the controllers as disclosed herein may include various microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof), and software which co-act with one another to perform operation(s) disclosed herein. In addition, such controllers as disclosed utilizes one or more microprocessors to execute a computer-program that is embodied in a non-transitory computer readable medium that is programmed to perform any number of the functions as disclosed. Further, the controller(s) as provided herein includes a housing and the various number of microprocessors, integrated circuits, and memory devices ((e.g., FLASH, random access memory (RAM), read only memory (ROM), electrically programmable read only memory (EPROM), electrically erasable programmable read only memory (EEPROM)) positioned within the housing. The controller(s) as disclosed also include hardware-based inputs and outputs for receiving and transmitting data, respectively from and to other hardware-based devices as discussed herein.

As moving coil transducers (or moving coil loudspeakers) increase their acoustic output, such transducers increase their distortion. This fundamental relationship drives the size, weight, cost, and in-efficiency of the transducer, all of which are undesirable. This may be particularly the case for transducers that are used in automotive applications where all of these performance issues are significant. At the same time, there is an ever-increasing need for higher output, lower distortion, systems that can achieve or provide desired active noise cancellation (ANC), engine order cancellation (EOC), individual sound zones (ISZ), and echo-cancelation for speech recognition.

Consequently, there are current sense methods, such as those described by Klippel which, through signal processing, attempt to minimize the distortion of the transducer, which in turn can, if used properly, enable the transducer designer to achieve smaller, lighter, lower cost, or more efficient solutions depending on the desired trade-off. However, these methods may be computationally expensive (e.g., 100 million instructions per second (MIPS) or more)), especially in multi-channel applications such as those found in automotive. Further, these methods often require an embedded micro-controller as well as a digital signal processor (DSP). Thus, there is a need for a low MIPs algorithm (e.g., which provides for comparatively low processing requirements) and low hardware cost method for non-linear distortion correction as provided herein. Moreover, the solutions should be compatible with automotive hardware which require comparatively low processing requirements.

In general, at a fundamental level, once control or correction of the non-linearities in a transducer are actively controlled and or corrected, the transducer and system designers have flexibility with respect to tradeoffs that may be necessary in a loudspeaker. This may improve size, weight, cost, and efficiency depending on the design goals. For example, embodiments disclosed herein may provide better control over the transducer's displacement or excursion and voice coil current which may allow the transducer to be driven closer to its limits and consequently provide more output. In addition, the embodiments disclosed herein provide enhanced control over the transducer's non-linear performance and may enhance the performance of acoustic algorithms which depend on the linearity or response of the transducer, such as ANC, RNC, EOC, ISZ, Echo cancelation, etc.

The embodiments disclosed herein may be: (i) robust and inherently predictable in terms of stability, repeatability, and inspect ability (i.e., not a black box), (ii) computationally simple with low to very low MIPs, sensor-less, (iii) adaptive with simple current sensing, and (iv) a simplification to the algorithm and operate in a DSP environment that may not need an accompanying embedded controller to be adaptive.

FIG. 1 generally depicts an example of an enclosed loudspeaker system 100 in accordance to one embodiment. The system 100 includes an enclosure 101 generally includes a loudspeaker 102 (or transducer) (e.g., an active loudspeaker or main driver) and a passive radiator 104 (or drone cone that does not receive electrical energy in the form an audio input signal). The enclosure 101 generally represents a common loudspeaker enclosure for transmitting audio signals and aspects related to the transducer 102 and the passive radiator 104 will be discussed in more detail hereafter.

Figure 2:
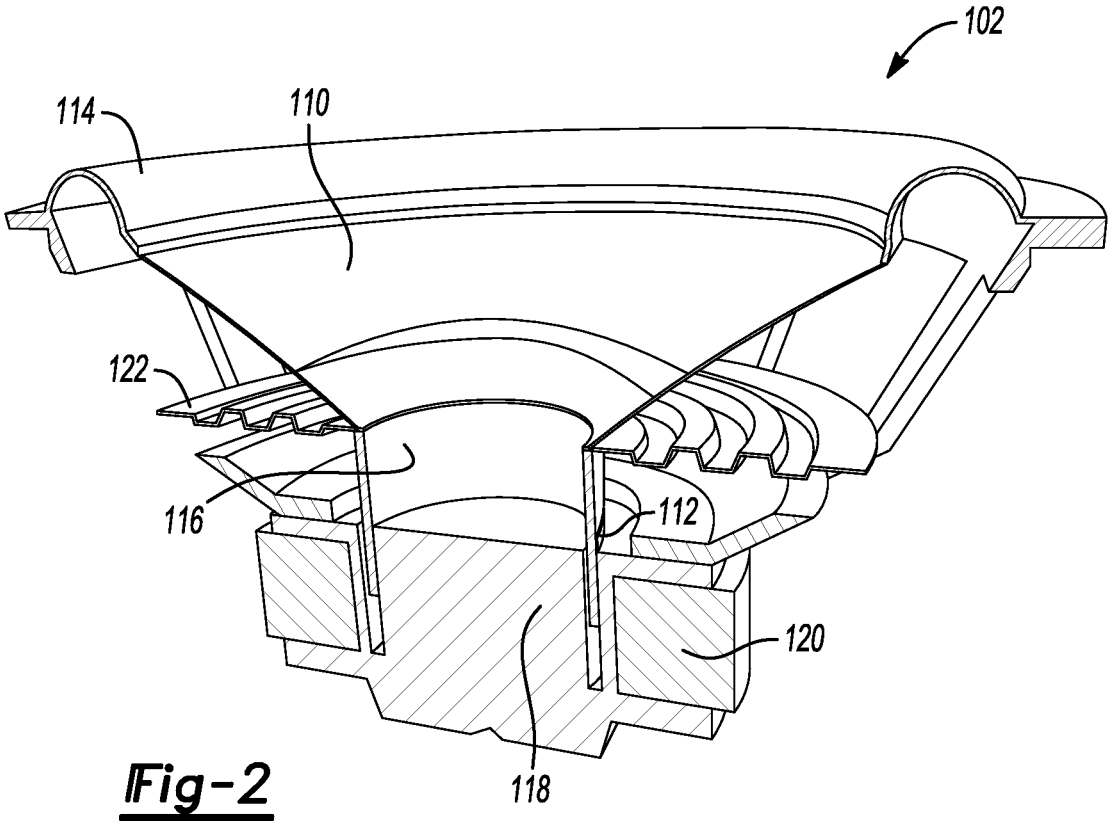
FIG. 2 generally depicts various aspects that comprise a transducer.

FIG. 2 generally depicts various aspects that comprise the transducer 102. For example, the transducer 102 generally includes a cone (or diaphragm) 110 and a voice coil 112. A surround (or suspension) 114 is attached at an end of the diaphragm 110. A former 116 surrounds the voice coil 112 and is positioned within an air gap 118. An outer magnet (or magnet) 120 surrounds the air gap 118 and at least a portion of the voice coil 112 and the former 116. A spider 122 surrounds a portion of the former 116.

In general, an audio input signal corresponding to audio data is provided to the voice coil 112. The voice coil 112 and the magnet 120 are magnetically coupled to one another and the audio input signal causes a linear movement of the diaphragm 110 in a vertical axis based on the polarity of the audio input signal. The diaphragm 110 is generally flexible and undergoes excursion in both directions on the vertical axis in response to the magnetic fields that are transferred between the voice coil 112 and the magnet 120. The former 116 is attached to the diaphragm 110 and undergoes a similar displacement (or movement along the vertical axis) as that of the diaphragm 110. As a result of the linear displacement of the diaphragm 110, the transducer (or loudspeaker) 100 transmits the audio input signal into a room or other environment for consumption by a user. The spider 122 is generally configured to prevent the diaphragm 110 from moving horizontally during the linear displacement of the diaphragm 110 in the vertical direction or axis.

Figure 3:
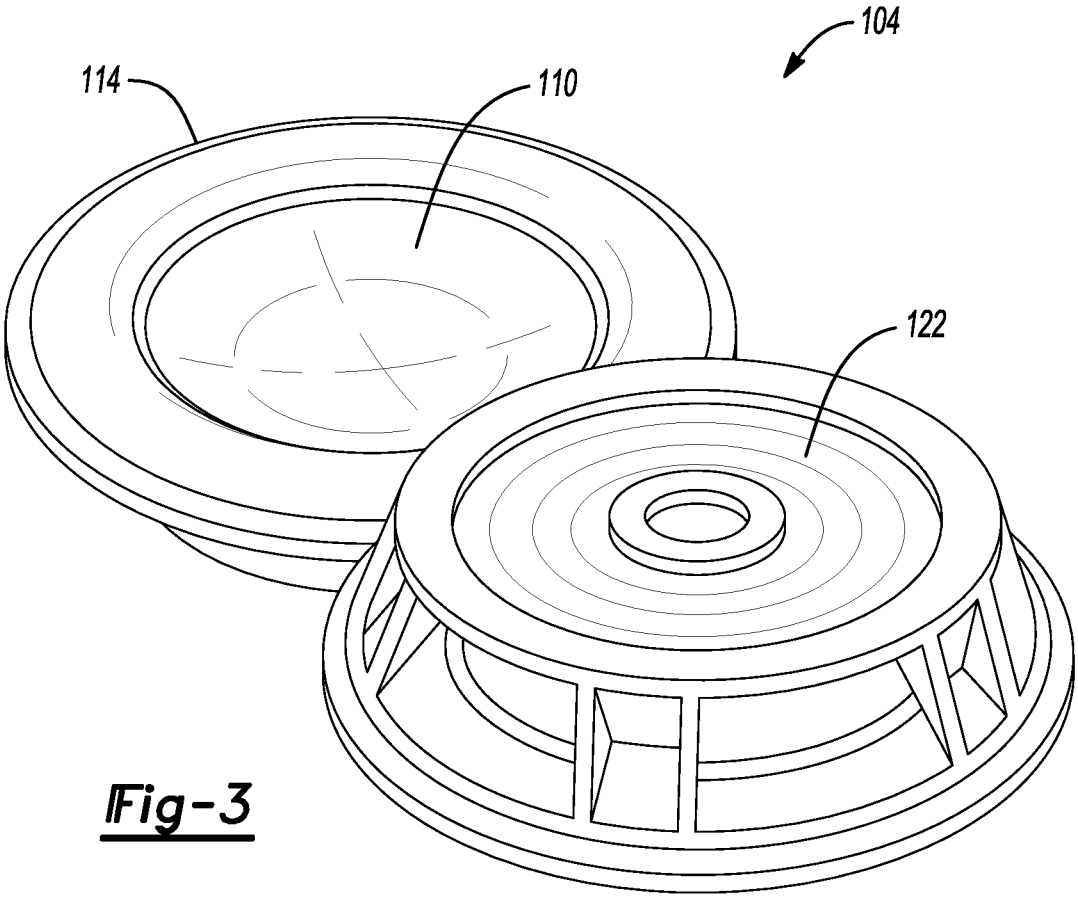
FIG. 3 generally depicts various aspects that comprise the passive radiator.

FIG. 3 generally depicts various aspects that comprise the passive radiator 104. In general, the passive radiator 104 may include all of the noted components that comprise the transducer 102 except for the voice coil 112 and the magnet 120. The passive radiator 104 may use sound that is trapped within the enclosure 101 to generate a resonance to provide low frequencies (i.e., bass). The passive radiator 104 may generate a frequency based on a mass and springiness (or compliance) of air within the enclosure 101. The passive radiator 104 may be tuned to the enclosure 101 by varying its overall diaphragm mass (including a weight of the diaphragm 110 or cone). As the transducer 102 generates air pressure due to the linear displacement of the diaphragm 110, such air pressure moves the passive radiator 104.

Figure 4:
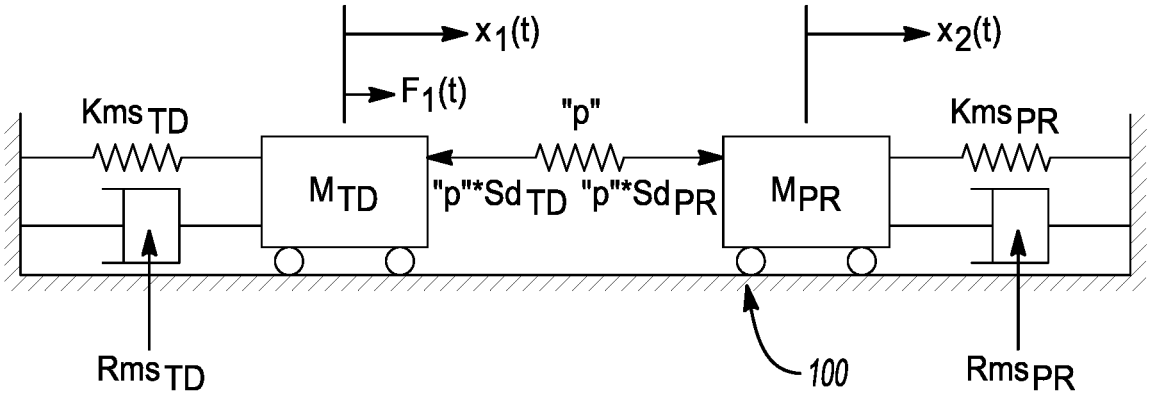
FIG. 4 generally illustrates a model of elements associated with the transducer and the passive radiator in the loudspeaker system.
Figure 5:
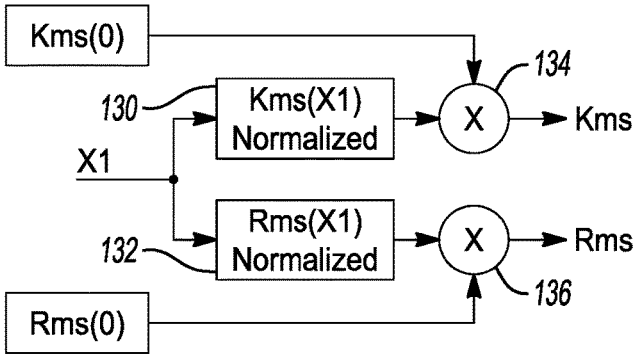
FIG. 5 generally illustrates a system that estimates Kms (x) and Rms (x) in the loudspeaker system in accordance to one embodiment.

FIG. 4 illustrates a model of elements associated with the transducer 102 and the passive radiator 104 in the loudspeaker system 100. In general, by mathematically modeling a behavior of the voice coil 112 (or the moving coil of the transducer 102) and the other mechanical elements in the loudspeaker system 100, it is possible to calculate a non-linear behavior and correct for the non-linear behavior using an amplifier and signal processing in real-time. These aspects will be discussed in more detail herein.

There are many ways to model the loudspeaker system however, if as this case here, there is a good pre-understanding of the physical elements of the system, a model fitted to the elements may be computationally simplest and easiest to tune. Aspects disclosed herein attempt to model the physical elements (e.g., the transducer 102 and the passive radiator 104) and their interaction in the loudspeaker system 100, in a way that can be directly calculated, adaptively tuned, and when the elements behave in a non-linear way, be corrected.

There are generally four sub-systems in the loudspeaker system 100: (1) the transducer 102 (which transduces the electrical signal from an amplifier (not shown) to a mechanical output (not shown)) (e.g., a mechanical output may be considered motion, this in turn transduces a mechanical output to an acoustic signal), (2) the passive radiator 104 (which resonates with the enclosure 101 and the transducer 102 to produce acoustic output at lower frequencies), (3) the enclosure 101 which couples (through pressure) the passive radiator 104 to the transducer 102 and isolates a back pressure for both the passive radiator 104 and transducer 102 from the front pressure, and (4) an amplifier and signal processing (now shown). Two simplified subsets of the loudspeaker system 100 may also be used such as a vented system, which replaces the passive radiator 104 with an acoustic mass that is created using a port in the enclosure 101, and a closed box system which has simply a sealed enclosure without a vent or a passive radiator 104. FIG. 4 illustrates a three mechanical sub-system and is analogous to a two-body resonant system.

In general, the mechanical elements for the transducer 102 can be modeled as a spring with a stiffness (e.g., Kms_TD), a damping (e.g., Rms_TD) and a moving mass (e.g., M_TD). M_TD corresponds to a mass of all of the moving parts including the air coupled to the diaphragm 110. Rms_TD corresponds to frictional losses of the surround 114 and the spider 122 combined. Kms_TD corresponds to the spring stiffness of the surround 114 and the spider 122 combined. In a similar manner, the passive radiator 104 can be modeled as a stiffness (e.g., Kms_PR), a damping (e.g., Rms_PR), and a moving mass (e.g., M_PR). The transducer 102 and the passive radiator 104 may be considered as the two bodies of the system 100. A force coupling the bodies can be modeled by pressure (e.g., relative to an ambient pressure outside of the enclosure 101) in the enclosure 101 times a surface area of the diaphragm 110 of the transducer 102 (e.g., Sd_TD) and diaphragm 110 of the passive radiator 104. The compressibility of the air in the enclosure 101 can be modeled as a spring with a stiffness of kappa "κ" (i.e., the adiabatic index of air, approximately 1.4) multiplied by the box pressure.

In the case of the voice coil 112 (or the moving coil of the transducer 102), a driving force F_1, can be modeled by a strength of a magnetic field in the air gap 118 (e.g., "B") times a length of conductor in the field "L", times the current in the conductor (e.g., the voice coil 112).

$$F_1(t)=B\cdot L\cdot i_{vc}(t)=BL\cdot i \qquad \text{Eq. (1)}$$

A frame of reference $x_1(t)$ is defined for a position of diaphragm 110 of the transducer 102. Similarly, a frame of reference $x_2(t)$ is defined for a position of the diaphragm 110 of the passive radiator 104. A positive direction of $x_1(t)$ is defined as moving into the enclosure 101 and a positive direction of $x_2(t)$ is defined as moving out of the enclosure 101.

Using the relationships that force of a moving mass is mass times acceleration, the force of a spring equals the distance from rest times, the spring stiffness, and the force of friction (or damping) is the velocity times the friction.

It is possible to represent forces on the moving mass of the transducer 102 (e.g., MmsTD) by:

$$B\cdot L\cdot i = M_{TD}\cdot\frac{d^2}{dt^2}x_1 + Kms_{TD}\cdot x_1 + Rms_{TD}\cdot\frac{d^1}{dt^1}x_1 + \kappa\cdot p\cdot Sd_{TD} \qquad \text{Eq. (2)}$$

where $x_1(t)$ is shown as $x_1$.

In a similar way, forces on the moving mass of the passive radiator 104 may be represented by:

$$-\kappa\cdot p\cdot Sd_{PR} = M_{PR}\cdot\frac{d^2}{dt^2}x_2 + Kms_{PR}\cdot x_2 + Rms_{PR}\cdot\frac{d^1}{dt^1}x_2 \qquad \text{Eq. (3)}$$

where $x_2(t)$ is shown as $x_2$.

Next, it may be generally necessary to calculate a pressure "p" based on a position of diaphragm 110 of the transducer 102 and of the diaphragm 110 of the passive radiator 104. This may be accomplished by first calculating a change in volume of the enclosure 101 (e.g., Vol_1) which in turn may be a volume of the enclosure 101 (e.g., Vol_0) minus the volume taken by the displacement of diaphragms 110 of the transducer 102 and the passive radiator 104 from a rest position. A volume of air is known to be proportional to the pressure and so:

$$Vol(x_1,x_2)=Vol_0+(S_{D_TD}\cdot x_1-S_{D_PR}\cdot x_2) \qquad \text{Eq. (4)}$$

Next by relating the relative pressure in the enclosure "p" to the relative volumes and the pressure outside the enclosure p_amb (for ambient), a new pressure resulting from a change in volume can be calculated by the following:

$$p(x_1, x_2) = \frac{Vol_0 \cdot p_{amb}}{Vol(x_1, x_2)} - p_{amb} \quad \text{Eq. (5)}$$

Note that "p" in the free-body force diagram (i.e., in FIG. 4) is p(x1,x2) in Eq. (5).

If Vol_0 is allowed to be the volume of the enclosure 101 with the diaphragms 110 (for both the transducer 102 and the passive radiator 104) at rest, then a change in pressure relative to the ambient pressure may be shown via Eq. 6 as shown below.

By combining the equations (4) and (5) to calculate the pressure in the enclosure 101 relative to ambient as a function of X1 and X2, the following is obtained:

$$p(x_1, x_2) = \frac{p_{amb} \cdot (S_D \cdot x_1 - S_{D_PR} \cdot x_2)}{Vol_0 + S_D \cdot x_1 - S_{D_PR} \cdot x_2} \quad \text{Eq. (6)}$$

This system of ordinary differential equations may then describe the motion of the diaphragms 110 (i.e., of the transducer 102 and the passive radiator 104) given a driving force from the voice coil 112. However, this does not yet account for the non-linear behavior.

Because of the shape of the magnetic field in the vicinity of the voice coil 112, BL is a non-linear function of position X1 of the diaphragm 110 of the loudspeaker 102. There may be several methods to model this aspect, but a simple method could use an $n^{th}$ order polynomial. For example, the following equations could represent BL as a function of position normalized to the rest position times the nominal value at the rest position:

$$BL=(cBL_4 \cdot x^4+cBL_3 \cdot x^3+cBL_2 \cdot x^2+cBL_1 \cdot x+1) \cdot BL(0) \quad \text{Eq. (7)}$$

While Eq. (7) illustrates a $4^{th}$ order polynomial, it is recognized that an nth order polynomial may be implemented for Eq. (7). Because of the physical attributes of the diaphragm's 110 suspension, Kms and Rms are non-linear functions of the position X1. As with BL, Rms and Kms can be represented as a polynomial. The polynomial has been factored into two sections such as a normalized part and a scalar part at X1=0 that corresponds to the rest position. The benefit of this will become clear in following improvements $$Kms=(cK_4 \cdot x^4+cK_3 \cdot x^3+cK_2 \cdot x^2+cK_1 \cdot x+1) \cdot Kms(0) \quad \text{Eq. (8)}$$

$$Rms=(cR_4 \cdot x^4+cR_3 \cdot x^3+cR_2 \cdot x^2+cR_1 \cdot x+1) \cdot Rms(0) \quad \text{Eq. (9)}$$

Eq. (8) and Eq. (9) can be shown from a signal flow standpoint as illustrated in Figure via a first normalized circuit 130, a second normalized circuit 132, a first multiplier circuit 134, and a second multiplier circuit 136. It is recognized that $cR_4 \cdot x^4$ and so on as depicted in the parenthesis of Eq. (8) and (9) correspond to the first normalized circuit 130 and the second normalized circuit 132, respectively. Each of the first normalized circuit 130 and the second normalized circuit 132 generally include hardware and software to perform the calculations required by Eqs. (8) and (9).

In the case of Rms, it may also be a function of a velocity of the diaphragm 110, which could also be modeled as a polynomial for example:

$$Rms=(cV_2 \cdot \text{velocity}^2+cV_1 \cdot \text{velocity}+1) \cdot Rms(x) \quad \text{Eq. (10)}$$

In Eq. (10), Rms(x) represents Rms of Eq. (9)

These equations can then be solved using a numerical method such as Euler's method, where the equations are iterated with small steps in time (small relative to the rate of change of position of any variable in the system 100). In particular, solving the system of Equations 1-10 will provide the velocity of the diaphragm 110. This will be described in more detail below.

Correction Via a Current Source

Figure 6:
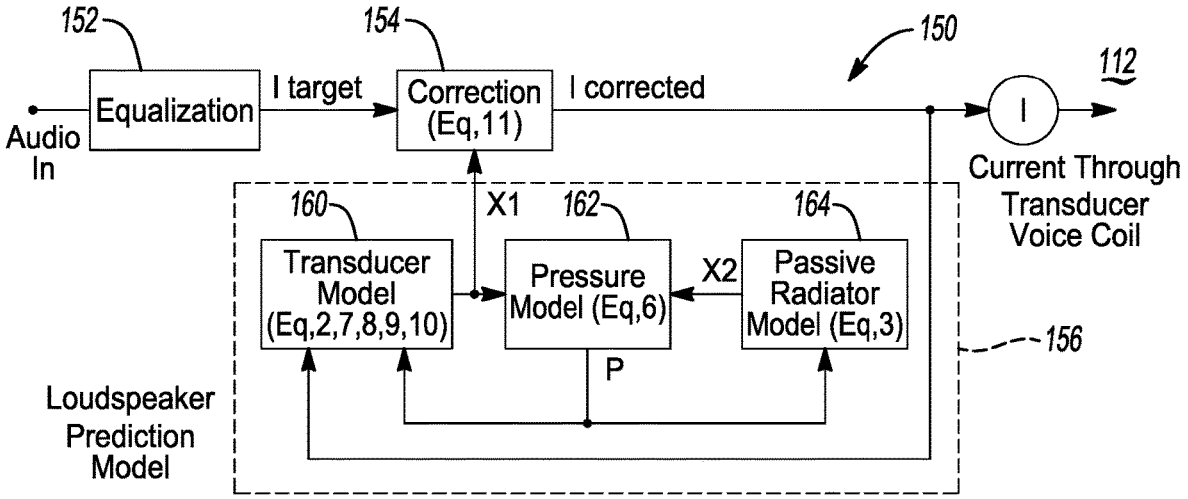
FIG. 6 generally illustrates an amplifier system that corrects distortion in the loudspeaker system in accordance to one embodiment.

Now that a model to estimate the position and velocity of the diaphragm 110 of the transducer 102 and the passive radiator 104 has been established, these aspects may be inserted into a system (or audio amplifier system) 150 to correct the distortion (see FIG. 6). The system 150 may be implemented as a current source amplifier (or audio amplifier) and generally includes an equalization block 152, a core correction block 154, a transducer prediction model block 156. The computationally simplest approach is to use the current source 158 to drive the voice coil 112. By nature of the current source 158, the system 150 eliminates the effect of the resistance in the voice coil 112 and inductance on the current and thus may be negated. The current source 158, by definition, feeds the desired current regardless of the load. In this approach, it may only be necessary to determine a corrected current for the voice coil 112.

The equalization block 152 generates a current target (or I_target) that corresponds to a desired current based on the audio input signal. The transducer model block 160 is generally fed an input current I_vc (or I corrected) which represents the current of the voice coil 112 produced by the amplifier 150 in response to at least the target current (i.e., I_target). The transducer prediction model block 156 includes a combination of hardware and software and calculates, per equations, 2, 3, 6, 7, 8, 9, and 10, the position X1 of the diaphragm 110 of the loudspeaker 102 (or the predicted positions of the voice coil 112). The system 150 provides I corrected to the voice coil 112 to move the voice coil 112 to the predicted position of X1 as determined by the transducer prediction model block 156. The transducer prediction model block 156 includes a transducer model block 160, a pressure model block 162, and a passive radiator model block 164). The transducer model block 160 executes equations, 2, 7, 8, 9, and 10. The pressure model block 162 generally executes equation 6 and the passive radiator model block 164 generally executes equation 3. Given Kms_TD (X1), BL(x) from their respective polynomials and the target current (I_target from the equalization block 152), the corrected current (e.g., I_current) to compensate for the non-linearities in Kms_TD(x) and and BL(x) can be calculated as follows:

$$I_{corrected} = I_{target} \cdot \frac{BL(0)}{BL} + \frac{x \cdot (Kms - Kms(0))}{BL} \quad \text{Eq. (11)}$$

Figure 7:
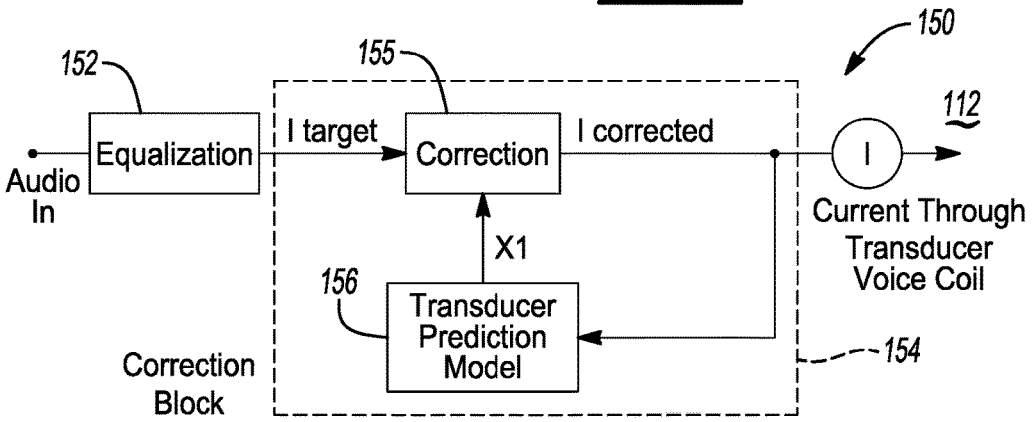
FIG. 7 represents the amplifier system of FIG. 6 and further includes a core correction block in accordance to one embodiment.

In general, the target current may be proportionately increased if BL(x) is less than BL(0) and has an amount added to offset the error in force due to the change in spring stiffness. In such a system, however a frequency response may be incorrect because the electrical damping provided by the resistance of the voice coil 112 may be negated by the amplifier 150 (or current source). The aspect may be compensated for by using a fixed equalization filter in the equalization block 152. FIG. 7 represents the amplifier 150 of FIG. 6 and further includes a core correction block 155 which can be improved on in later implementations.

Correction Via a Voltage Source

Figure 8:
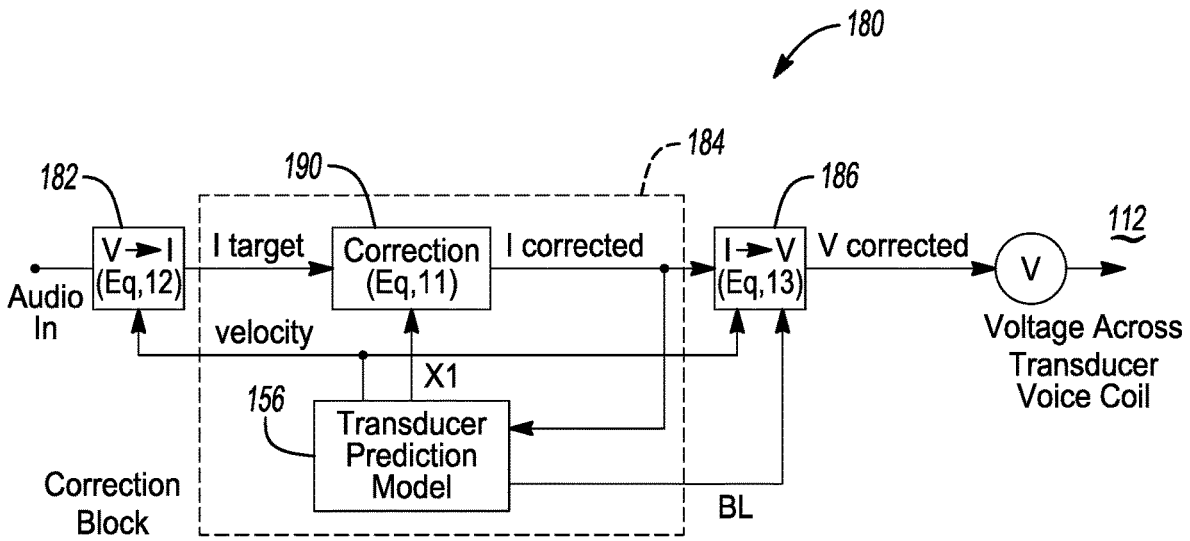
FIG. 8 depicts a correction system that serves as a voltage source to drive the voice coil in accordance to one embodiment.

FIG. 8 depicts an audio amplifier system 180 that serves as a voltage source to drive the voice coil 112. The system 180 includes a current transform block 182, an adaptation block 184, and a voltage transform block 186. The system 180 provides a corrected voltage to the voice coil 112 of the transducer in response to the audio input signal. The adaptation block 184 includes a core correction block 190 and the transducer prediction model block 156. In general, the system 180 converts a target voltage (from an equalization block that is not shown (the target voltage is generated based on the audio input signal)) into a target current (i.e., I_target)) via the current transform block 182. The core correction block 190 corrects the target current to generate a corrected current (i.e., I_corrected). The voltage transform block 186 converts I_corrected into a corrected voltage (i.e., V_corrected) which is used to drive the voice coil 112. A voltage source amplifier (not shown) applies V_corrected to the voice coil 112. The system 180 ignores the effects of the inductance of the voice coil 112, which generally works if the correction is for lower frequencies of the system 180. This may be valid because most of the movement and non-linearity occurs at a low frequency.

The system 180 also utilizes a predicted velocity of the diaphragm 110 in addition to the position of the diaphragm, X1 (see outputs from the transducer prediction model block 156). The current transform block 182 utilizes the velocity of the diaphragm 110 to convert the audio signal (which is proportional to a voltage) to the target current, I_target and transmits the same to the core correction block 190. The voltage transform block 186 also converts I_corrected to a signal that is proportional to the voltage that is to be applied to the voice coil 112. The transducer prediction model block 156 also provides the predicted BL (or predicted magnetic flux X and the length of the air gap 118). The voltage transform block 186 also requires the predicted BL to convert the I_corrected to the V_corrected as per equation 13 which is set forth below.

In general, it is necessary to convert the target voltage (i.e., the input into the current transform block 182) into I_target for use in the transducer prediction model block 156. For example, movement of the voice coil 112 carries a current that produces a voltage proportional to the velocity times "B" times "L" which corresponds to a length of an air gap; this may be referred to as a back EMF of the voice coil 112. This provides a voltage that is subtracted from the voltage (i.e., V_corrected) that is applied to the voice coil 112 leaving the balance across a resistance of the voice coil resistance (e.g., Rvc). The linear target current (i.e., I_corrected) that would match the voice coil current if BL(x) was linear can then be calculated by the following:

$$I_{target} = \frac{(V_{target} - \text{velocity} \cdot BL(0))}{Rvc_{nominal}} \quad \text{Eq. (12)}$$

Once the target current is corrected as similarly noted before, this needs to be converted back to a corrected voltage (i.e., Vcorrected). Based on the same relationship, this may be accomplished with the following equation:

$$V_{corrected} = I_{corrected} \cdot Rvc_{Avg} + BL \cdot \text{velocity} \quad \text{Eq. (13)}$$

Variation in the Voice Coil DC Resistance (Rvc)

In a simple approach, a resistance of the voice coil 112 may be assumed to be constant. Assuming that the resistance of the voice coil 112 is constant, $Rvc_{Avg}$ in Eq. (13) would be set to $Rvc_{nominal}$. In general, voice coils be formed of copper or aluminum. These materials may encounter a change of resistance as their corresponding temperature changes. Thus, to improve the voltage source implementation of the system 180, a thermal model may be used to estimate a temperature rise of the voice coil 112 and thereby calculate a temperature corrected resistance of the voice coil 112. The power in the voice coil 112 may be obtained because the current is predicted as I_corrected. There are several thermal models that may be used based on accuracy. The simplest may be an RC model where R represents the thermal resistance of the voice coil 112 to ambient and C represents the specific heat capacity of the voice coil 112. The RC model can also be solved iteratively using Euler's method.

One example of Euler's method to iteratively solve system equations is set forth direction below. By looping through code of an algorithm as shown below, over and over, the algorithm solves the various system of equations in small time steps such that equations may move over a small-time step to be considered and treated as linear. For example, a time step of 200 uS (for a sample rate of 5 kHz) may adequately model a typical loudspeaker. This model may require down-sampling or decimation at the input (e.g., audio input which may be, for example, 48 KHz) and Vcorrected and Icorrected output which may be 48 KHz) and up-sampling with an interpolation filter at the output (e.g., and Vcorrected and Icorrected output which may be 48 KHz). With this approach, a fixed-point full implementation may require about 5-6 MIPS per channel for a full passive radiator system and a minimum of 1-2 MIPS for a closed box system.

```
*/
//Solving for the transducer motion:
//dt is defined as a small-time step of the sampled system

    X1=X1+Velocity_TD*dt;

    Force_damping_TD=−Velocity_TD*Rms(X1)_TD;

    Force_spring_TD=−X1*Kms(X1)_TD

    Force_pressure_TD=−k*pressure*Sd_TD;

    Force_motor=BL(X1)*Ivc_corrected;

    Force_net_TD=Force_damping_TD+
        Force_spring_TD+Force_pressure_TD+Forc-
        e_motor;

    Velocity_TD=Velocity_TD+Force_net_TD/M_TD*dt;
//Solving for a motion of the passive radiator 104:

    Force_damping_PR=−Velocity_PR*Rms(X2,Veloci-
        ty_PR)PR;

    Force_spring_PR=−X2*Kms(X2)_PR;

    Force_pressure_PR=k*pressure*Sd_PR;

    Force_net_PR=Force_damping_PR+
        Force_spring_PR+Force_pressure_PR;

    Velocity_PR=Velocity_PR+Force_net_PR/M_PR*dt;

    X2=X2+Velocity_PR*dt;
//Solving for a change in pressure of the enclosure 101:

    pressure=p_0*(Sd_TD*X1−Sd_PR*X2)/(Vb+Sd*X1+
        Sd_PR*X2);
//Solving for a corrected current of the voice coil 112:

    Ivc_corrected=Ivc_target*BL(0)/BL(X1)+(Kms(X1)−
        Kms(0)*X1/BL(X1);
```

//For the voltage source algorithm, the following C-code may be added:
//Solving for Ivc_target $$Ivc_target=(EQ_out-Velocity_TD*BL(X1))/Rvoice_coil;$$

//Solving for a corrected voltage of the voice coil 112:

$$V_voicecoil=Ivc_corrected*Rvoice_coil+BL(X1)*Velocity_TD.$$

Variation in Kms and Rms as a Result of Motional History

The model has also assumed that Kms and Rms, while in motion, is defined by one polynomial. In fact, these parameters may vary with a "history" of movement. For example, the suspension 114 of the diaphragm 110 may soften as the diaphragm 110 is moved with significant velocity and displacement. This may change both Rms and Kms.

As an improvement, the values of Kms and Rms may be scaled using an estimate of the changing value of Rms(0) and Kms(0) with time. Since the polynomials for Kms(x) and Rms(x) are normalized to the rest position, the time varying parameter can multiply directly the normalized position varying parameter to determine a more accurate Kms and Rms.

The softening and stiffening of the suspension 114 of the diaphragm 110 as a function of position can be predicted as an average over time which may be modeled as a sum of exponential decays, where the input to the averaging corresponds to a steady-state value of Kms and Rms that may result if the magnitude of the motion where applied indefinitely. This steady-state value of Kms may be represented as a polynomial Eq. (14)) of the envelope of the changing position.

$$Kms_{steadystate}=a_1\cdot|x|+a_2 \quad \text{Eq. (14)}$$

The exponential decay may take the form of the following equation.

$$\frac{1}{n}\cdot\left(e^{\frac{-t}{\tau_1}}+e^{\frac{-t}{\tau_2}}\ \ldots+e^{\frac{-t}{\tau_n}}\right) \quad \text{Eq. (15)}$$

An average Kms (or $Kms_{Avg}$) may then be calculated by multiplying Eq. (15) with Eq (14). This average Kms would then replace the Kms(0) in Eq. (8) to provide:

$$Kms=(cK_4\cdot x^4+cK_3\cdot x^3+cK_2\cdot x^2+cK_1\cdot x+1)\cdot Kms_{Avg} \quad \text{Eq. (16)}$$

The same form of equation may be used for Rms steady-state $$Rms_{steadystate}=b_1\cdot|x|+b_2 \quad \text{Eq. (17)}$$

steady-state Rms

As with Kms, Eq. (15) and Eq. (17) can be used to relate the steady state Rms to the magnitude of motion. An average Rms may then be calculated by multiplying Eq. (15) with Eq(17). This average Rms would then be then replace Rms(0) in Eq. (9) to provide:

$$Rms=(cR_4\cdot x^4+cR_3\cdot x^3+cR_2\cdot x^2+cR_1\cdot x+1)\cdot Rms_{Avg} \quad \text{Eq. (18)}$$

$Kms_{Avg}$ and $Rms_{Avg}$ as set forth in equations 15 and 16 takes the history of the predicted positions of the voice coil 112 by averaging X1 over its recent history.

Combined Precision Over-Excursion Compression and Limiting, Frequency Compensation, and Non-Linear Correction It is recognized that the embodiments disclosed herein may generally provide for, but not limited to, advanced loudspeaker protection with precision over-excursion, frequency compensation, and non-linear correction without a look-ahead that may be suitable for amplifier applications including an improved auto-tuning power manager. Current implementations of a power manager as used in automotive amplifiers may be difficult to manually tune, may not take into account aspects of a changing environment such as process, tolerances, ageing etc. These aspects may lead to a "guard band" in protection which may eliminate usable acoustic output thereby causing the system to be quieter. The embodiments herein may combine precision over excursion limiting with non-linear correction and frequency compensation in a way that does not require look-ahead to avoid transient over-excursion.

One or more of the embodiments as disclosed herein when combined with adaptive loudspeaker parameter extraction as set forth in U.S. Application No. 62/955,125 ("the '125 application) entitled "SYSTEM AND METHOD FOR ADAPTIVE CONTROL OF ONLINE EXTRACTION OF LOUDSPEAKER PARAMETERS" filed on Dec. 31, 2019 which is hereby incorporated by reference in its entirety. The '125 application may provide, inter alia, an accurate loudspeaker protection mechanism when compared to the conventional power manager devices as used in connection with automotive amplifiers. One or more of the noted embodiments may enable loudspeakers to be pushed harder reliably with less margin and thereby play louder. Conversely, one or more of the embodiments may also require less margin which may provide lighter loudspeaker designs.

In addition, current power managers that provide protection for automotive loudspeaker designs have to be manually tuned. This may be time consuming for engineers that are involved in developing transducers, amplifiers and/or digital signal processors (DSPs). Further, these implementations may not be adaptive. Current power managers may not be precise and may need look-ahead to avoid transient over-excursions that are potentially damaging. Thus, this aspect may not provide adequate protection for ANC applications which are often very demanding.

The disclosed system(s) and/or method(s) may accurately limit over-excursion but may also, in combination with a correction for the transducers non-linear elements, prevent the voice coil from overheating. Moreover, since various acoustic implementations may be implemented in real-time such as ANC which may not use a look-ahead delay, any such limiting of the over-excursion should operate without a look ahead. Further, since the disclosed limiter for the transducer(s) may be required to be pushed closer to their excursion limit without increased risk of damage, such a limiter may allow occasional transients to over-excursion. In addition, a limiter may be required to operate over production tolerances, process variation, product life-span, and environmental conditions such as temperature. Thus, the limiter may need to have the capability of allowing for auto-tuning. If auto-tuning parameters may be available, then the disclose system(s) and/or method(s) may enable auto-tuning.

The disclosed embodiments may improve power management capability for amplifiers (e.g., automotive amplifiers). Existing power managers may not protect against transient over-excursion without look-ahead without considerable margin. This adds weight and cost to the transducer and without careful time intensive manual tuning. In addition, existing power managers may need a transducer engineer to manually create tables of data for the DSP engineer to set up the Power Manager and then finally a system engineer to finish the manual tuning. Aspects disclosed herein, when combined with auto-tuning of the loudspeaker parameters may eliminate nearly all of noted deficiencies including risk of error and requirement for margin.

Figure 9:
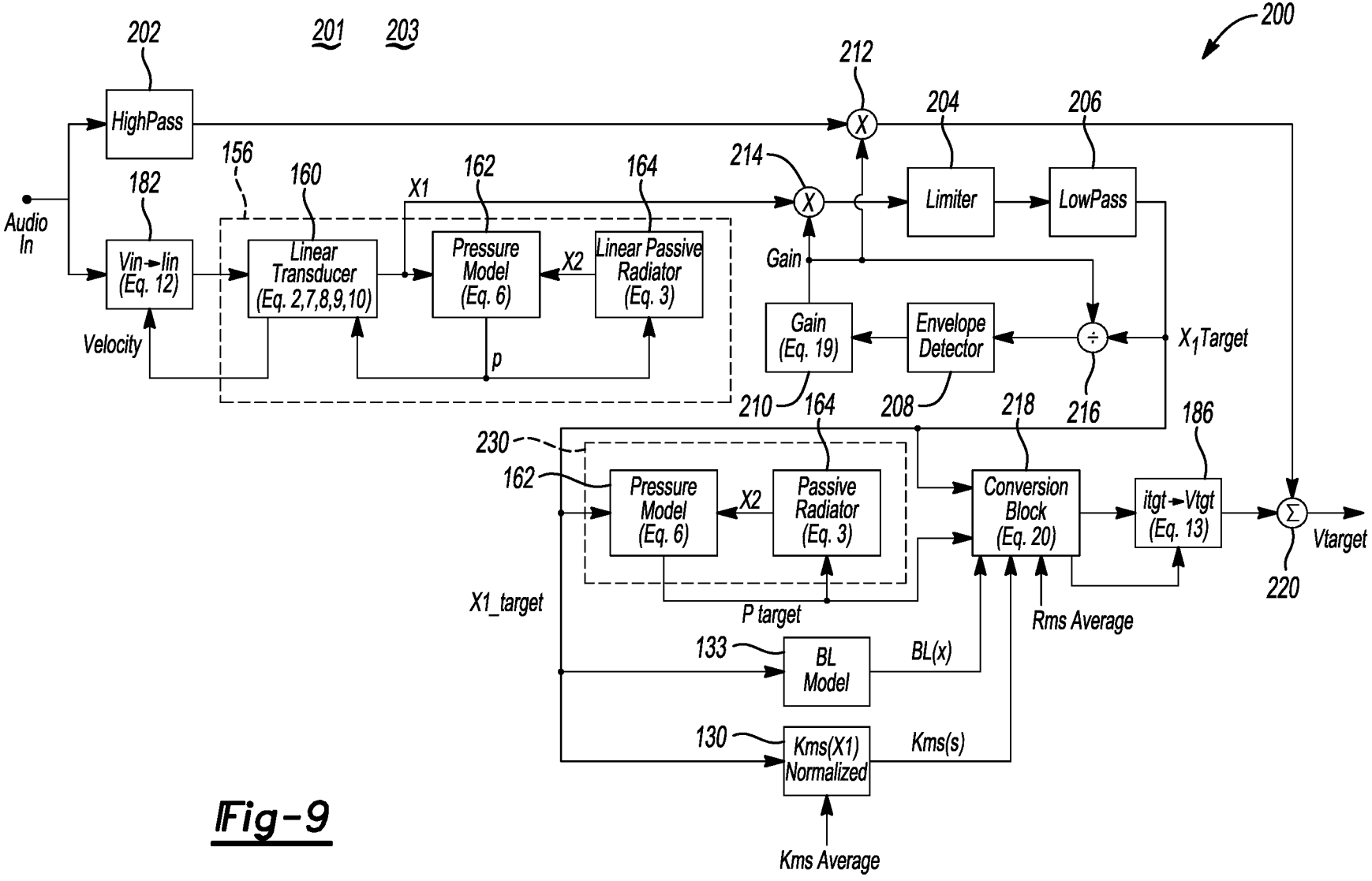
FIG. 9 depicts a system for providing advanced loudspeaker protection in accordance to one embodiment.

FIG. 9 depicts a system 200 for providing advanced loudspeaker protection in accordance to one embodiment. The system 200 may be implemented in an audio amplifier 201 that includes any number of controllers 203 (hereafter "the controller 203"). The controller 203 may be programmed to execute instructions that carry out the following operations performed by the system 200 in addition to systems 350 and 400 as set forth below. The system 200 generally includes the KMS normalized block 130, the BL model block 133, the transducer prediction model block 152, the transducer model block 164, the pressure model block 162, the passive radiator model block 164, the current transform block 182, a voltage transform block 186, a filter 202 (e.g., high pass filter 202), a limiter block 204, a filter 206 (e.g., low pass filter 206), an envelope detector 208, a gain block 210, a first multiplier circuit 212, a second multiplier circuit 214, a divider circuit 216, a conversion block 218, and an adder circuit 220. In general, the system 200 may protect the loudspeaker 102 from over-excursion of the voice coil 112. An input audio signal is provided to the current transform block 182 and to the high pass filter 202.

The system 200 provides the input audio signal in a high frequency band (e.g., via the high pass filter 202) and in a low frequency band (e.g., via the low pass filter 206) therethrough to be received at the adder circuit 220. It is recognized that the input audio signal may be, for example, an ANC based signal. With the input audio signal being limited in the low frequency band, signals present in the high frequency band may not be distorted. Each of the high pass filter 202 and the low pass filter 206 may operate, for example, as $4^{th}$ order filters with a Q of 0.5 and matching corner frequencies. This may result in a flat undistorted frequency response when the low-pass and high-pass signals are added back together via the adder circuit 220. The selection of the corner frequency may be, for example, around 2 to 3 times the resonance of the loudspeaker 102 where the movement of the voice coil 112 may be reduced sufficiently in that limiting may not be needed.

The current transform block 182 receives the input audio signal and converts the same into a signal that represents an input current utilizing equation 12 as set forth above and as further set forth below for reference:

$$I_{in} = \frac{\left(V_{in} - \frac{d^1}{dt^1}x_1 \cdot BL(0)\right)}{Rvc_{nominal}} \quad \text{Eq. (12)}$$

where $Rvc_{nominal}$ is the room temperature DC resistance of the voice coil 112. BL(0) is the voice coil motor force factor when the voice coil 112 is at rest (X1=0). X1 is the position of the voice coil 112. BL may be set to 0 and not to X as noted above and Rvc is set at room temperature. The transducer prediction model block 156 receives the output from the current transform block (e.g., $I_{in}$) to calculate the desired position of the voice coil, X1. In this instance, the transducer prediction model block 156 may designate the non-linear parameters as constant values, for example, as if the desired position of the voice coil 112, X1 is fixed at the rest position. This may cause the model to be linear. In this case, the transducer prediction model block 156 may determine a calculation for a non-distorted position for the voice coil 112 that may have resulted as if the loudspeaker 102 is linear. As part of this calculation, a velocity, dx1/dt is calculated for use in Eq (1) above. As noted above, the transducer prediction model block 156 (i.e., the linear transducer model 160) may first solve the following equation using Euler's method or other similar iterative numerical methods to find X1 (e.g., see Eq. 2 above where BL, Kms, Rms remains constant and therefore Eq 2 becomes linear).

As stated above, the linear passive radiator model block 164 determines the position of the passive radiator 104 by solving via Euler's method, equation 3 which is again provided below for reference.

$$-\kappa \cdot p \cdot Sd_{PR} = M_{PR} \cdot \frac{d^2}{dt^2}x_2 + Kms_{PR} \cdot x_2 + Rms_{PR} \cdot \frac{d^1}{dt^1}x_2 \quad \text{Eq. (3)}$$

In this case, BL, Kms, and Rms may remain constant thereby causing equation 3 to remain constant.

The pressure model block 162 may then solve for the pressures as noted above. After which, the pressure model block 162 may solve for the pressure "p" in accordance to equation 6 as provided above and also set forth below for reference.

$$p(x_1, x_2) = \frac{p_{amb} \cdot (S_D \cdot x_1 - S_{D_PR} \cdot x_2)}{Vol_0 + S_D \cdot x_1 - S_{D_PR} \cdot x_2} \quad \text{Eq. (6)}$$

As noted above, the model employed by the pressure model block 162, may be simplified for the vented, closed box, and infinite baffle acoustic systems. Once the pressure "p" is determined, the linear transducer model block 160 may determine the position of the voice coil 112 of the loudspeaker 102 (e.g., X1). The transducer prediction model block 156 provides the position of the voice coil 112 to the variable gain block (or gain stage) 210 via the second multiplier circuit 214, the limiter block 204, the low pass filter 206, the divider circuit 216, and the envelope detector 208). The second multiplier circuit 214 changes the magnitude of the signal when the envelop of signal provided by the low pass filter 206 is higher than the maximum displacement desired. The divider circuit 216 rescales the signal to the input signal X1 prior to such a signal reaching the second multiplier circuit 214 to achieve a stiff knee in a compressor. The second multiplier circuit 214 in combination with the gain block 210 form the compressor. The gain block 210 performs the function as described in connection with equation 19 which compares the envelope signal from the envelope detector 208 to a threshold. The gain block 210 reduces the gain value if the envelope is above the threshold.

The gain block 210 may reduce the gain applied to the position of the voice coil 112, X1 if the non-distorted position X1 is above a pre-determined threshold. For example, the divider circuit 216 rescales X1 to a target to the same scale of X1 and the gain block 210 compares X1 to the desired threshold. During the reduction of the gain applied to the position of the voice coil 112, X1, the limiter block 204 may only be active for a brief period of time. In general, as the envelope catches up to the transient, the gain is reduced and the limiter block 204 may no longer be needed. For example, equation 19 as set forth directly below provides the manner in which the gain block 210 adjusts the gain.

$$\text{gain}(X_1)=X_1 \text{ for } X_1 \leq \delta$$

$$\text{gain}(X_1)=a \cdot X_1+(1-a) \cdot \delta \text{ for } X_1>\delta \quad \text{Eq. (19)}$$

where:

δ threshold a<1 attenuation $X_1$ envelope $x_1$.

The envelope detector 208 determines an envelope of the position of the voice coil 112, X1. For example, the envelop detector 208 converts an alternating current (AC) (bidirectional) signal into a DC (unidirectional or positive only) signal. The envelope detector 208 may then capture the peaks of such a signal. The envelope detector 208 may then smoothly control the gain. If the envelope detector 208 is not implemented, then the gain would only be reduced on the peaks, which in essence reverts the system to a simple limiter which is audible and objectionable. If a time delay and smoothing of the envelope is provided, this gradually reduces the undesired audible characteristic of only the limiter block 204. The limiter block 204 provides instantaneous detection but with the condition that when the audio is turned down, this causes an undesired audible noise which is not preferred. However, with the implementation of the envelope detector 208, this provides a gradual reduction of the undesired audible portion so that it is not noticed by the listener. Because the maximum input to the peak detector is limited (e.g., the input to the envelope detector 208 is limited), the overshoot of the compressor (or collectively the gain block 210 and the second multiplier block 214) is reduced. If this is done however the input needs to be first multiplied by 1/Gain otherwise the compressor (e.g., the gain block 210 and the second multiplier block 214) will have limited effect. The divider circuit 216 is provided to provide a stiff knee. Without the divider circuit 216, the only way the gain is reduced is if the target position of the voice coil 112, X1 is increased which results in a soft knee and hence not good control. For example, the volume increases (e.g., the soft knee scenario) with no limits. With the divider circuit 216, a stiff knee characteristic is present were there is a gradual increase in the volume until the volume reaches an intended maximum that cannot be exceeded.

Additionally or alternatively, the input to the peak detector may be taken from before the Gain multiplication stage (not shown). In this case, the input may not need to be multiplied by 1/Gain. However, preventing the gain block 210 from having any overshoot may require a slower attack rate which will force the limiter block 204 to be more active and more audible. In all cases, the attack rate of the envelop detector 208 may be optimized to prevent the gain block 210 from over compressing. This may be in the range of, for example, tens of milliseconds. In addition, the envelope detector 208 may have a slow release to prevent the gain block 210 from pumping or releasing and attacking with each peak or transient. The release time may be in the order of, for example, hundreds of milliseconds.

Once the gain block 210 (and the second multiplier block 214) compresses the output of the envelope detector 208, the limiter block 204 may then limit the excursion and temperature of the voice coil 112. In general, once the position signal (e.g., position of the voice coil 112, X1) has been compressed by the gain block 210, the limiter block 204 may then limit the signal. For example, once the non-distorted position signal has passed through the gain multiplication stage (e.g., the gain block 210, the second multiplier circuit 214, and the divider circuit 216), the non-distorted position signal may then be presented to the limiter block 204. The limiter block 204 may then limit a positive and a negative position to at least one predetermined maximum that may be safe for the transducer 102. The limiter block 204 generally accounts for sudden and high-level transients that may not be adequately compressed because of an attack delay. If such a condition was allowed to transpire, the voice coil 112 may strike a back plate (not shown) positioned on the transducer 102 and be damaged.

The first multiplier circuit 212 may multiply the output of the gain block 210 with the audio output of high pass filter 202. This aspect may keep the balance between high and low frequencies about the same which may be less objectionable than simply reducing the low frequencies. Once the gain block 210 and the limiter block 204 compress and limit, respectively, the signal X1, the signal may then be provided as X1_target to the pressure model block 162 and the passive radiator model block 164 (e.g., see secondary model block 230). The secondary model block 230 may determine the velocity of the diaphragm 110, the pressure and the non-linear parameters. Since non-linear elements of the transducer 102 may be corrected for, in the next stage in the process, the resulting position of the voice coil 112 may be the same as the non-distorted position of the voice coil 112. The pressure model block 162 may calculate the pressure in the enclosure 101 via equation 4 and the passive radiator model block 164 may calculate the position of the passive radiator via equation 5. For example, equations 4 and 5 may be solved again using Euler's method or other suitable comparable numerical technique.

In general, it may be necessary to convert back to the current that is needed based on equation 20 as set forth below. For example, the conversion block 218 may convert outputs from the low pass filter 206, the secondary model block 230, the KMS normalized block 130, and a BL model block 133 into a target current ($I_{tgt}$). Since equation 6 utilizes the non-linear parameters as noted above, to correct for the non-linear distortion, a desired voice coil current (i.e., the target current ($I_{tgt}$)) is calculated using the following equation.

$$i_{target} = \frac{M_{TD} \cdot \frac{d^2}{dt^2} x_{1_tgt} + Kms_{TD} \cdot x_{1_tgt} + Rms_{TD} \cdot \frac{d^1}{dt^1} x_{1_tgt} + \kappa \cdot p \cdot Sd_{TD}}{BL} \quad \text{Eq. (20)}$$

In general, Eq. 20 sets for the manner in which non-linear parameters may be solved. Since all the inputs to the conversion block 218 (or Eq. 20 are known), the conversion block 218 may require obtaining the derivative and $2^{nd}$ derivative of X1_target and solve the equation for the target current, $I_{tgt}$. However, for the conversion block 218 to correct for non-linear elements KmsTD and BL as illustrated in equation 20; such elements may be a non-linear KmsTD (x1_tgt) and BL(x1_tgt). These values may be calculated as set forth above and further provided directly below for references in connection with equations 7 and 8, respectively.

$$BL=(cBL_4 \cdot x^4+cBL_3 \cdot x^3+cBL_2 \cdot x^2+cBL_1 \cdot x+1) \cdot BL(0) \quad \text{Eq. (7)}$$

And $$Kms=(cK_4 \cdot x^4+cK_3 \cdot x^3+cK_2 \cdot x^2+cK_1 \cdot x+1) \cdot Kms_{Avg} \quad \text{Eq. (8)}$$

In addition, the system 200 may be made tunable for automatic tuning and may compensate for changes in frequency if Kms average and RmsTD are periodically updated from a real-time system that extracts these parameters. Aspects that provide an extraction technique, such as for example, that utilizes bandpass filters will be described in more detail below. In general, one or more of the embodiments may provide blending the correction for non-linear distortion with a position limiter by providing an appropriately pre-distorted voltage to the voice coil 112.

If the amplifier 201 is configured as a current source, then the target current, $I_{tgt}$ may be used directly. Since most amplifiers are configured as voltage sources, the target current, $I_{tgt}$ may be converted to a voltage. For example, the voltage transform block 186 may convert the target current, $I_{tgt}$ into a voltage target, $V_{target}$ with the following equation:

$$V_{target} = BL \cdot \frac{d^1}{dt^1} x_{1_tgt} + I_{target} \cdot R_{vc} \quad \text{Eq. (21)}$$

If the nonlinear parameters of BL(x) are used, equation 21 may be used for correction. The adder circuit 220 sums the output of the high pass filter 202 (e.g., high frequency input audio signal) with the voltage target, $V_{target}$ to provide the total flat frequency response. The voltage target, $V_{target}$ generally corresponds to the amount of voltage to drive/move the voice coil 112 to the desired position without experiencing over excursion and over temperature conditions.

It is recognized that it may be possible to ignore the non-linear elements and therefore not utilize equations 7 and 8. However there may be errors if equations 7 and 8 are not used. For example, this may result in errors since the assumption that X1_target and X1 in the real speaker is no longer valid. However, such an error may be small enough to be ignored if an objective is to primarily protect the loudspeaker 102.

In addition, it may be possible to eliminate the high-pass/lowpass filter structure (e.g., high pass filter 202 and the low pass filter 206). While the system 200 may have some performance degradation, such a degradation may be acceptable in certain instances. For example, the elimination of the high-pass/low pass structure may degrade the incoming audio signal because of increased distortion from the limiter block 204 and because limiting low frequency signals may also distort high frequency signal present at the same time. It is also possible to include some of the other model elements as described above to improve the model particularly if Kms average and Rms average are not extracted separately.

Figure 10:
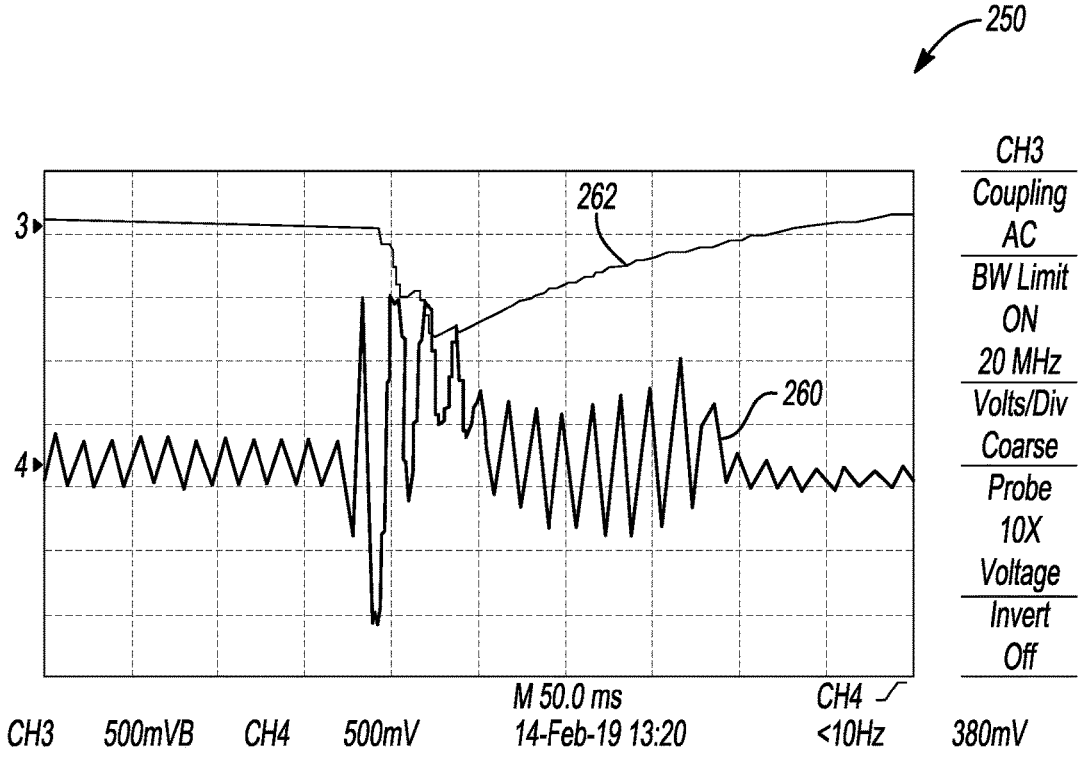
FIG. 10 corresponds to a plot that illustrates a behavior of a compressor and limiter with a loudspeaker in accordance to one embodiment.
Figure 11:
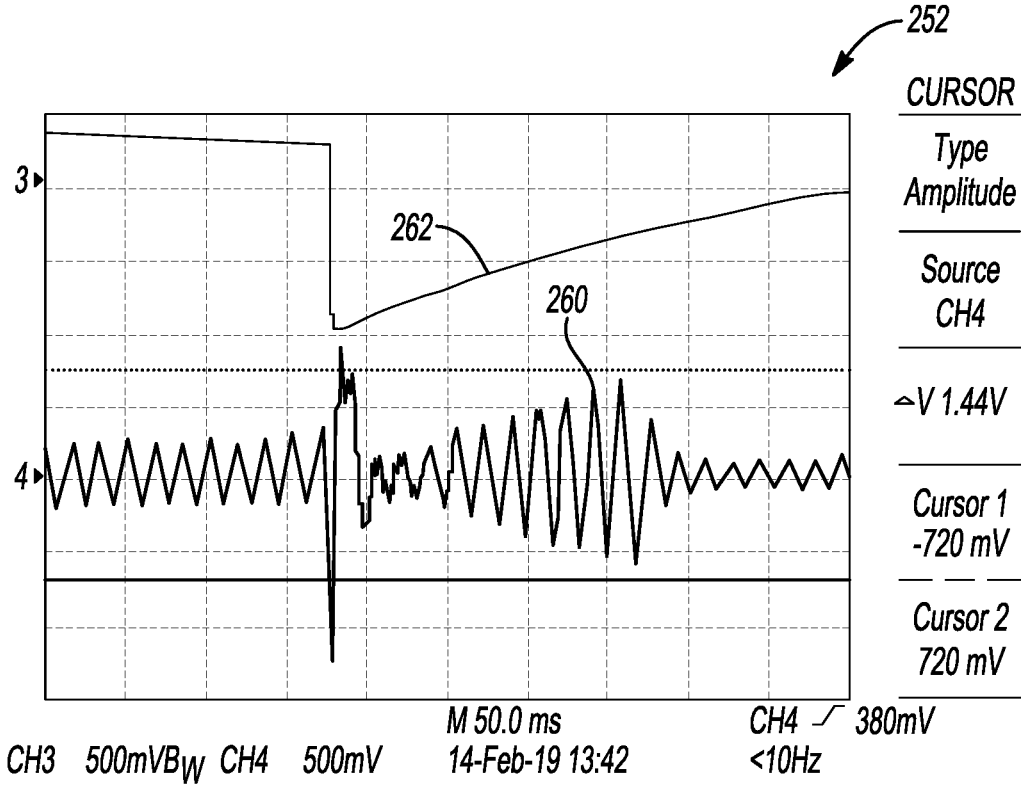
FIG. 11 corresponds to a plot that illustrates a slow attack to avoid over compression that may allow for a large over excursion in addition to an allowance of a low frequency artifact.
Figure 12:
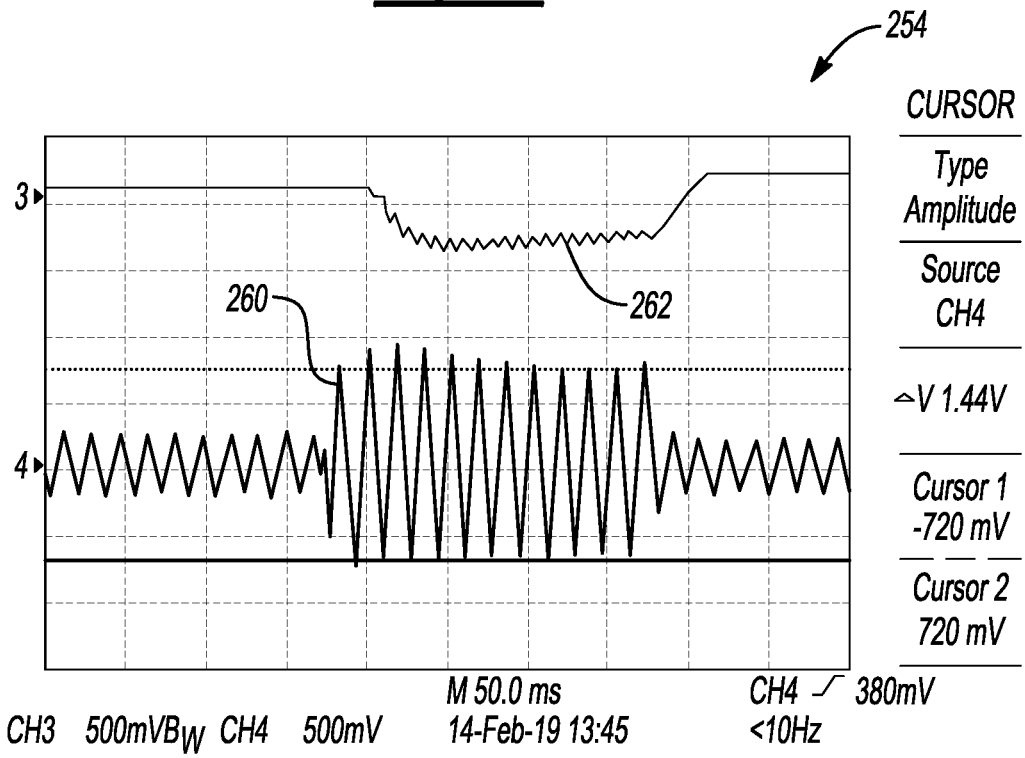
FIG. 12 corresponds to a plot that illustrates a fast attack to avoid a low frequency artifact but that may allow over excursion.

FIGS. 10-12 generally provides plots 250, 252, and 254, respectively, that illustrate a behavior of the compressor (or gain block 210) and the limiter block 204 with the loudspeaker 102 in accordance to one embodiment. For example, FIGS. 10-12 generally illustrate the behavior of the gain block 210 and the limiter block 204 with an actual loudspeaker when a sudden large signal is applied and removed. Waveform 260 corresponds to the position of the voice coil 120 as the voice coil 120 moves in and out during a high power transient. Waveform 262 corresponds to a gain of the gain block 210 as the compressor engages to reduce the overly high signal. As can be seen, the delay in the compressor gain reduction allows an initial over excursion that may damage the loudspeaker 112. FIG. 11 generally illustrates a slow attack that is used to avoid over compression and that allows for a large amount of over excursion of the voice coil 112 as well as a major low frequency artifact. In this case, there may not be over compression, however many transients may pass through (e.g., could be a stray drumbeat, bass strum or bump in the road for a vehicle application (e.g., road noise cancellation).

FIG. 12 illustrates a fast attack that avoids the low frequency artifact while still allowing for excursion of the voice coil 112. Waveform 260 of FIG. 12 depicts the intended maximum excursion of the voice coil 112. The over compression may lead to pumping of the compressor (or gain block 210) with each transient which may be annoying to the listener. In other words, if the attack of the gain block 210 is too fast, then the gain block 210 over compresses which leads to a muffling of the audio or sounds like the volume is being modulated. With the present embodiment, the limiter block 204 may be utilized which provides a slower attack and a faster release that can be used without pumping the gain block 210 (or even brief over-excursion). This is considered in-audible which may be the goal.

Figure 13:
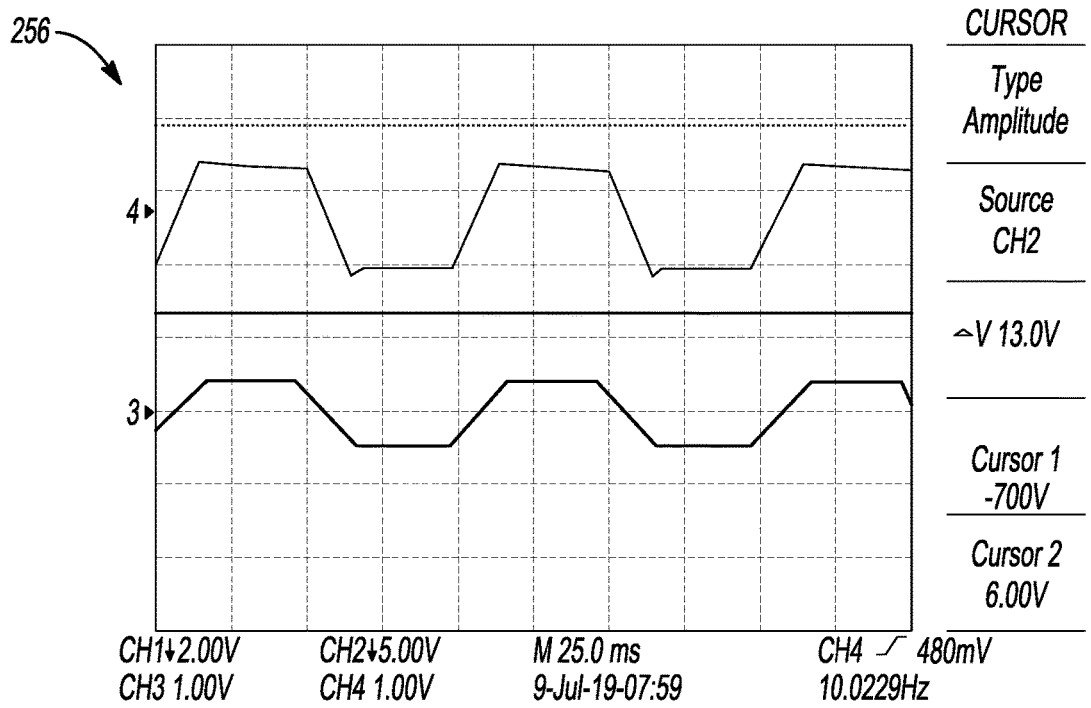
FIG. 13 corresponds to a plot depicting the effects of a limiter that controls a maximum position without a compressor.

FIG. 13 provides a plot 256 depicting the effects of the limiter block 204 that controls a maximum position without the use of the compressor (or gain block 210). The plot 256 illustrates the limiter block 204 controlling the maximum position without the compressor 210. In effect, this illustrates clipping the position through control to avoid damage to the voice coil 112 of the transducer 102. In general, plot 256 illustrates that the behavior or the limiter block 204 being active on its own without the compressor (e.g., the envelope detector 208, the gain block 210, and the second multiplication circuit 214 being engaged to reduce the gain. The plot 256 further illustrates that the displacement of the voice coil 112 is limited to the desired maximum displacement.

Extraction Technique (Using Band Pass Filters)

As previously mentioned, the system 200 may be made to auto-tune or be adaptive to the changing parameters of the loudspeaker 102. For example, an eight-tracking band-pass filter may be grouped into four sets of two filters. One set of filters may track the impedance maximum found at the resonance frequency. A second set of filters may track the impedance minimum found above resonance frequency of the loudspeaker 102. A third and fourth set of filters may track −3 dB points in the impedance curve above and below the resonance frequency of the loudspeaker 102 where the impedance is half the impedance maximum. For each set of two filters, the inputs may be the voice coil voltage and current. The output of each filter may be converted to an RMS (root-mean-squared) value. The impedance, then at each set of filters bandpass frequency, is the RMS value corresponding to voltage is divided by the RMS value corresponding to current. Once these values are known, the Q ((e.g., quality of the mechanical system ($Q_{ms}$), quality of the electrical system (QEs), as well as of the quality of the total (complete) system ($Q_{TS}$) of the system may be calculated by definition from half impedance points. In general, the quality factor Q, is a defined engineering term and for loudspeaker such a term may be related to the bandwidth of the resonance peak in the impedance frequency response. The resonance frequency may be the frequency of the band-pass filter tracking the impedance maximum. The impedance minimum may be used as a good approximation of the DC resistance of the voice coil 112. From the Q, $F_{resonance}$, and Rdc; the average Kms and Rms may be calculated for a closed box or infinite baffle acoustic system based on the following relationships.

The following disclosure provides the manner in which Q, F res and Rdc are relevant to Kms(avg) (eq. 23) and Rms(avg) (eq. 13) and Mms (see eq. 12 below).

From the maximum impedance Zmax and Rdc, the following may be calculated:

$$R_{MT} = \frac{BL^2}{(Z_{max} - R_{dc})} + \frac{BL^2}{R_{dc}} \quad \text{Eq (22)}$$

From the result of equation 22 directly above, it is possible to calculate ½Pi×$F_{resonance}$ and Qts determine the average Kms:

$$K_{MS} = Q_{ts} \cdot \frac{R_{MT}}{T_T} \quad \text{Eq. (23)}$$

From the result of equation 22, calculate ½Pi×$F_{resonance}$ to determine the following:

$$M_{MS} = \tau_T^2 \cdot K_{MS} \quad \text{Eq. (24)}$$

From Zmax and Rdc, determine the average Rms:

$$R_{MS} = \frac{BL^2}{(Z_{max} - Rdc)} \quad \text{Eq. (25)}$$

If BL is not known, a normalized value of 1 may be used. However, this aspect may require matching the thresholds for the displacement limit to be calibrated. For example, by measuring a sudden increase in distortion in the voice coil 112, current as the amplitude of displacement may be increased. This aspect may then correspond to the limiter threshold and used to scale the calculated normalized displacement to the correct level. If BL is not known, then it is possible calibrate at least the point in which the displacement is too high which may be found by a sudden increase in distortion in the voice coil current. The distortion fingerprint from the '125 application may be used to the maximum displacement.

Alternatively, the above set of equations may be solved instead where Mms is known or normalized to 1 and Kms, BL, and Rms are solved for. Since the tracking band-pass filter outputs have a noise floor below some minimum signal level in any of the bands, the output may be un usable. To prevent the system from becoming unstable under these conditions, the last known good value of Kms average and Rms average is used until new good values are available. In general, there are signals where it may not be possible to use the BP filter implementation, but these will be mitigated against. There may be several implementations to implement the tracking. One implementation may include utilizing feedback to adjust the tracking frequency up or down based on whether the impedance is decreasing or increasing.

Online Adaptive Extraction of Parameters

The '125 application as set forth above introduces the concept of obtaining a number of parameters associated with the loudspeaker 102 in an online and adaptive matter. For example, the '125 application sets forth one or more audio systems that may provide the resistance of the voice coil 112 (e.g., Rdc), the estimated resonance frequency of the loudspeaker 102 (e.g., fres), a resistance of the loudspeaker 102 at the resonance frequency (e.g. Res), the quality of the total (complete) system (e.g. Qts), the Impedance of the loudspeaker 102, etc.). These features may be found based on, inter alia, determining an admittance curve of the loudspeaker 102. By obtaining these parameters on the fly, it is possible to control, inter alia, the maximum excursion of the voice 112 and to provide a thermal limiter to prevent the loudspeaker 102 from being damaged as discussed below.

Over Temperature Protection

Figure 14:
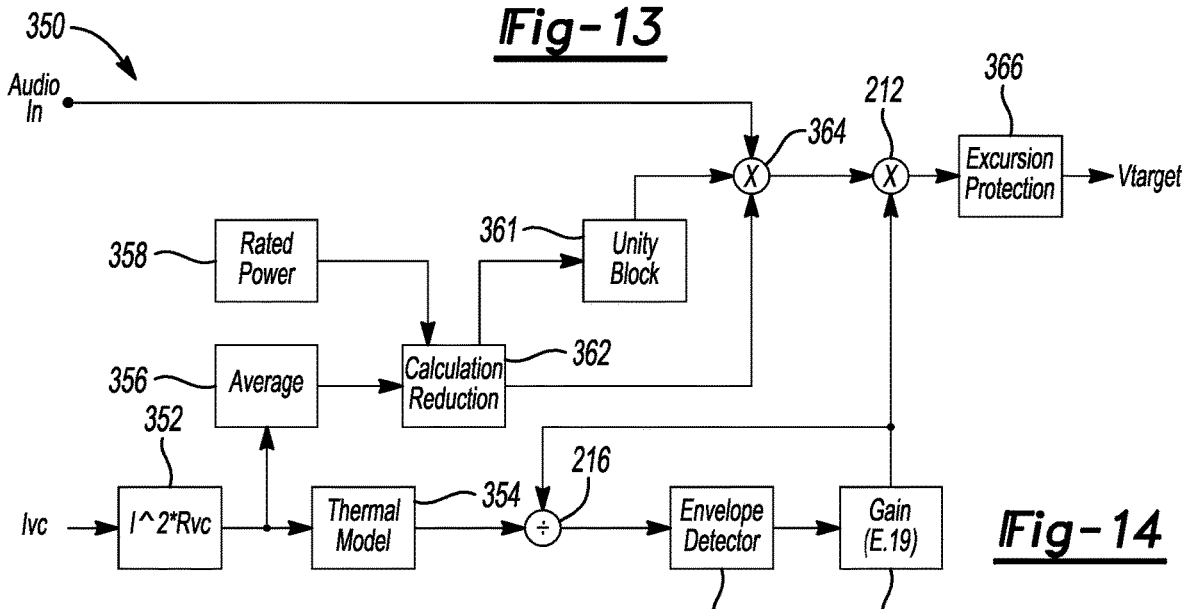
FIG. 14 depicts a system for protecting a loudspeaker from an over temperature condition of a voice coil in accordance to one embodiment.

FIG. 14 depicts a system 350 for protecting the loudspeaker 102 from an over temperature condition of the voice coil 112 in accordance with one embodiment. In general, the system 350 includes a portion of the system 200 as described above in connection FIG. 9 (e.g., over-excursion protection aspect provided by the system 200) and is preceded by a thermal protection mechanism which may turn down the level of the input audio signal when the temperature of the voice coil 112 is above a predetermined temperature threshold that may have the potential to harm the voice coil 112.

The system 350 includes a power calculation block 352, a thermal model block 354, an average calculation block 356, a rated power block 358, a comparator circuit 360, a unity block 361, a calculation reduction block 362, a multiplier block 364, and an excursion protection block 366. The system 350 also includes the envelop detector block 208, the gain block 210 (or compressor 210), the first multiplication block 212, and the divider circuit 216. The power calculation block 352 determines the power loss in the voice coil 112 by first off, determining the voice coil current Ivc, squaring the voice coil current Ivc and then dividing the squared value of Ivc by the DC resistance of the voice coil 112, Rdc. It is recognized that Rdc may be obtained via the disclosure of the '125 application and the utilization of Rdc via the '125 application may provide for increased accuracy.

If the manner of obtaining Rdc via the '125 application is not possible, then the resistance Rdc of the voice coil 112 may be calculated by taking a temperature rise and the thermal coefficient of resistance for the voice coil 112. In general, the resistance Rdc may be known along with the amount Rdc changes. Thus, the temperature may be derived from this aspect. For example, because the metal in the voice coil wire changes its resistance with temperature, by knowing the resistance, it is possible to calculate the temperature. If a direct measurement is not provided, then the thermal model block 354 may determine the temperature. For example, the thermal model block 354 may determine the temperature after receiving the power loss in the voice coil 112 via the power calculation block 352. The thermal model block 354 may employ a simple $1^{st}$ order thermal model that utilizes a thermal resistance between the voice coil 112 and ambient, and a thermal capacitance of the voice coil 112, both in parallel with the voice coil power loss modeled as a current.

The voice coil current may be measured with appropriate hardware, such as, for example, a current sense and an analog to digital (A-to-D) converter (both of which are not shown). However, if this hardware is not available in the system 350, the current may be taken from the transducer prediction model block 152 of FIG. 9. The thermal model block 354 may then provide the temperature of the voice coil 112 to the gain block 210 (e.g., via the divider circuit 216 and the envelope detector block 208 as discussed above). In this case, the attack and release speed may be in seconds as opposed to milliseconds. The attack and release may be in a time frame similar to the thermal time constants of the system. If the attack and release are too fast, the compressor (e.g., the envelope detector 208, the gain block 210, and the second multiplier circuit 214) may overreact. In contrast, if the attack and release are too slow, then the compressor 208, 210, and 214 may under react.

In addition, since the power loss is known (e.g., as calculated by the power calculation block 352), the average calculation block 356 receives the power loss of the voice coil 112 and determines an average power of the power loss. The comparator 360 determines whether the average power as output from the average calculation block 356 is greater than a rated power as provided by the rated power block 358. If the average power is less than the rated power, then the comparator 360 provides an output to the unity block 361 which multiples the output by one. Thus, a gain change will not occur and the output of the unity block 361 is then provided to the multiplier block 364.

If however the average power is greater than the rated power, then the comparator 360 provides an output thereof to the square root block 362. In turn, the calculation reduction block 362 reduces the signal level by the square root of the rated power divided by the average power. The calculation reduction block 362 may utilize the square root because power is proportional to the signal level squared. The average power may be estimated over a long time period similar to the thermal time constant of the voice coil 112. It is possible to use the measured power loss or the calculated power loss and then use the temperature model block 354 to determine the temperature. In general, the multiplier circuit 364 and/or the divider circuit 362 can adjust a magnitude of the signal Vtarget that is provided to the loudspeaker 102.

The excursion protection block 366 serves to lower the incoming signal Vtarget because the average power is too high (e.g., above the rated power), then the excursion of the voice coil will be less but since this protection relates to the average, excursion protection may still be required as transients may be much higher than the average. In general, the excursion protection block 366 performs the same operations as noted in connection with FIG. 9. The excursion protection block 366 generally includes the KMS normalized block 130, the BL model block 133, the voltage transform block 186, the limiter block 204, the low pass filter 206, and the conversion block 218.

Figure 15:
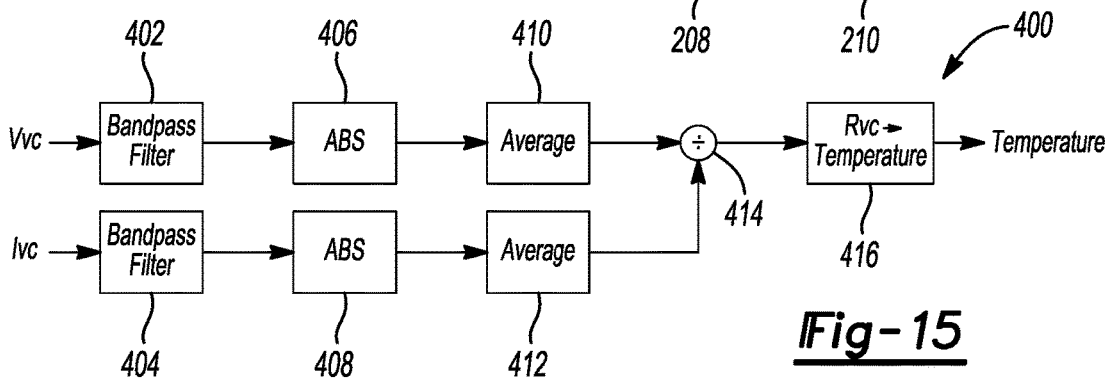
FIG. 15 depicts a system for providing an accuracy of a temperature of a voice coil that may be measured indirectly in accordance to one embodiment.

FIG. 15 depicts a system 400 for providing an accuracy of a temperature of a voice coil 112 that may be measured indirectly in accordance to one embodiment. This approach uses the same bandpass filter concept mentioned above (e.g., the minimum frequency where the impedance is a minimum (see also the '125 application). For example, the system 400 includes bandpass filters 402, 402, absolute value blocks 406, 408, average calculation blocks 410, 412, a divider circuit 414 and a temperature calculation block 416. Each of the bandpass filters 402, 404 may have a narrow pass band frequency tuned close to where the minimum impedance of the voice coil 112 occurs above resonance of the loudspeaker 102. Thus, the bandpass filter 402 enables a frequency on a voltage output of the voice coil 112 (e.g., Vvc) that corresponds to the minimum impedance of the voice coil 112 that occurs above resonance of the loudspeaker 102 to pass through to the absolute value block 406. Similarly, the bandpass filter 404 enables a frequency on a current output from the voice coil 112 (e.g., Ivc) that corresponds to the minimum impedance of the voice coil 112 that occurs above resonance of the loudspeaker 102 to pass through to the absolute value block 408.

The divider circuit 414 divides the average of the absolute value of the voltage, Vvc by the average of the absolute value of the current, Ivc to provide the magnitude of the impedance at the impedance minimum (e.g. to provide the resistance of the voice coil 112, Rdc). This impedance may be dominated by Rdc of the voice coil 112. Thus, it may be taken to a first approximation to be the magnitude of Rdc. Once Rdc is known, and then by using the thermal coefficient of resistance for the voice coil 112, the temperature calculation block 416 may determine the temperature. The temperature may be used instead of the calculated temperature from the thermal model block 354 (see FIG. 14) previously mentioned because the temperature determined by the temperature calculation block 416 may be more accurate. This approach however requires that the current through the voice coil is measured.

In general, the above approach may be adequate if there is enough signal energy at the frequency of the bandpass filters 402, 404. If not, the results may become erroneous and preferably should be ignored. This may be accomplished by comparing the average of the absolute value of the current to a threshold. If the average of the absolute value of the current is below a threshold where noise may become a problem, then the results should be ignored. If this is the case, then the modeled temperature as set forth in FIG. 14 may be used instead.

Figure 16:
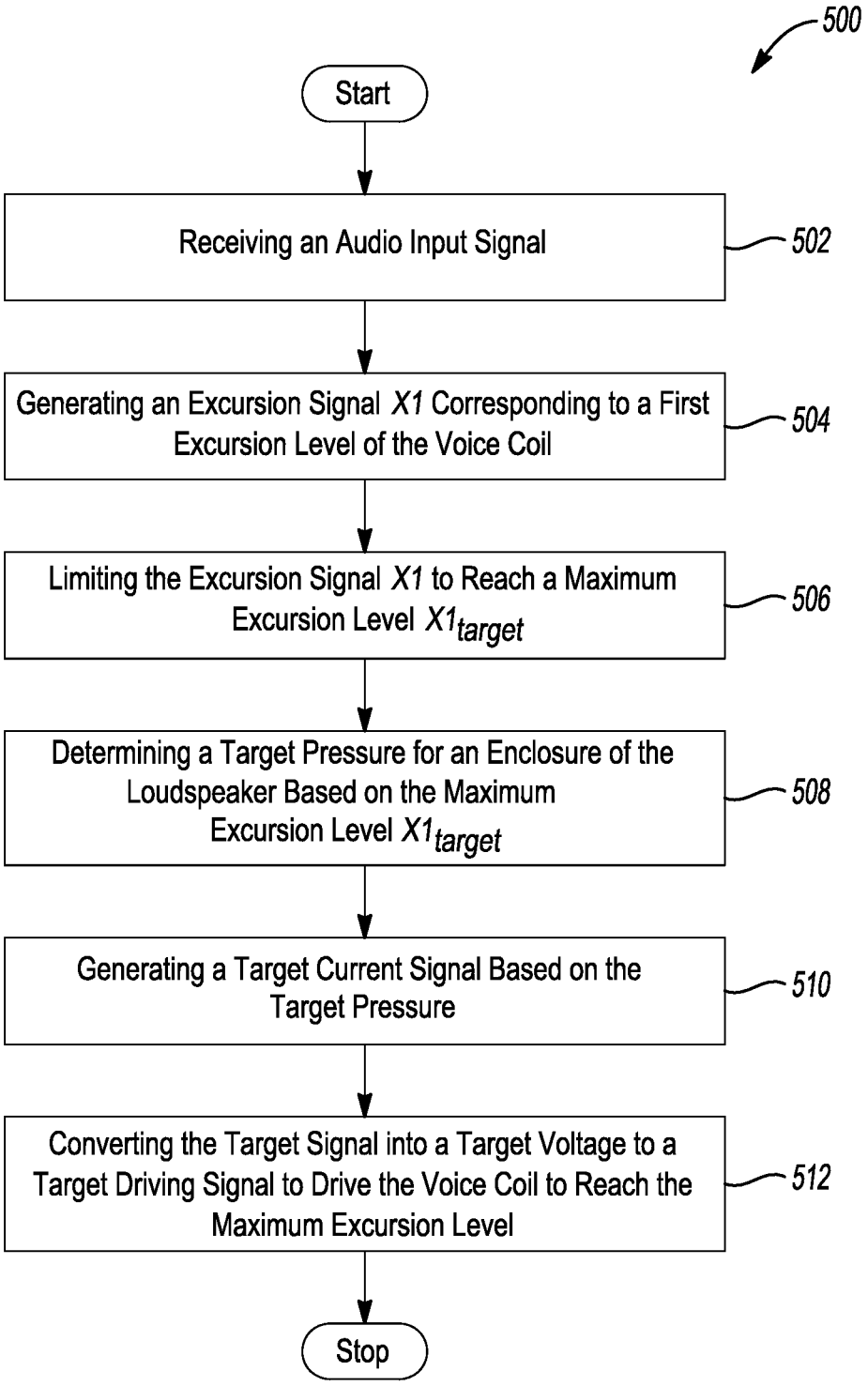
FIG. 16 depicts a method for providing advanced loudspeaker protection in accordance to one embodiment.

FIG. 16 depicts a method 500 for providing advanced loudspeaker protection in accordance to one embodiment. In operation 502, the audio amplifier 201 receives an audio input signal.

In operation 504, the transducer prediction model block 156 generates an excursion signal X1 that corresponds to a first excursion level of the voice coil 112 based on the audio input signal. As illustrated in connection with FIG. 9, the transducer prediction model block 156 utilizes, inter alia, the pressure in the enclosure 101 associated with the loudspeaker 102 to generate the excursion signal X1.

In operation 506, the limiter block 204 limits the excursion signal X1 to reach a maximum excursion level X1_target. For example, the limiter block 204 generates the maximum excursion level X1_target. In operation 508, the secondary model block 230 determines a target pressure (P_target) for the enclosure 101 associated with the loudspeaker 102 based on the maximum excursion level X1_target. In operation 510, the conversion block 218 generates a target current signal ($i_{tgt}$) based at least on the target pressure (P_target) for the enclosure 101. In operation 512, the voltage transform block 186 converts the target current signal ($i_{tgt}$) into a target voltage signal ($v_{tgt}$) (or driving signal) to drive the voice coil 112 to reach the maximum excursion level (e.g., X1_target).

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An audio amplifier system comprising:

a loudspeaker including a voice coil for generating an audio output into a listening environment; and an audio amplifier being operably coupled to the loudspeaker and being programmed to:

receive an audio input signal;

generate an excursion signal corresponding to a first excursion level of the voice coil based on the audio input signal;

limit the excursion signal to reach a maximum excursion level; and determine a target pressure for an enclosure of the loudspeaker based on the maximum excursion level;

generate a target current signal based at least on the target pressure; and convert the target current signal into a target voltage signal to a target driving signal to drive the voice coil to reach the maximum excursion level.

2. The audio amplifier system of claim 1, wherein the audio amplifier is further programmed to apply a first filter to the maximum excursion level prior to determining the target pressure for the enclosure.

3. The audio amplifier of claim 2, wherein the first filter is a low pass filter.

4. The audio amplifier system of claim 1, wherein the audio amplifier includes a compressor that is programmed to compress the excursion signal prior to limiting the excursion signal to reach the maximum excursion level.

5. The audio amplifier system of claim 1, wherein the audio amplifier includes a compressor programmed to receive the maximum excursion limit to control a gain of the maximum excursion limit prior to determining the target pressure.

6. The audio amplifier of claim 1, wherein the audio amplifier is further programmed to generate the target current signal based on a stiffness of a diaphragm of the loudspeaker.

7. The audio amplifier of claim 1, wherein the audio amplifier is further programmed to apply a first filter to the audio input signal.

8. The audio amplifier of claim 7, wherein the first filter is a high pass filter.

9. The audio amplifier of claim 7, wherein the audio amplifier is configured to apply the target voltage signal to an output of the first filter prior to driving the voice coil to reach the maximum excursion level.

10. A computer-program product embodied in a non-transitory computer read able medium that is programmed for protecting a loudspeaker, the computer-program product comprising instructions for:

receiving an audio input signal;

generating an excursion signal corresponding to a first excursion level of a voice coil of the loudspeaker based on the audio input signal;

limiting the excursion signal to reach a maximum excursion level; and determining a target pressure for an enclosure of the loudspeaker based on the maximum excursion level;

generating a target current signal based at least on the target pressure; and converting the target current signal into a target voltage signal to a target driving signal to drive the voice coil to reach the maximum excursion level.

11. The computer-program product of claim 10 further comprising applying a first filter to the maximum excursion level prior to determining the target pressure for the enclosure.

12. The computer-program product of claim 11, wherein the first filter is a low pass filter.

13. The computer-program product of claim 10 further comprising compressing the excursion signal prior to limiting the excursion signal to reach the maximum excursion level.

14. The computer-program product of claim 10 further comprising receiving the maximum excursion limit to control a gain of the maximum excursion limit prior to determining the target pressure.

15. The computer-program product of claim 10 further comprising generating the target current signal based on a stiffness of a diaphragm of the loudspeaker.

16. The computer-program product of claim 10 further comprising applying a first filter to the audio input signal.

17. The computer-program product of claim 16, wherein the first filter is a high pass filter.

18. The computer-program product of claim 16 further comprising applying the target voltage signal to an output of the first filter prior to driving the voice coil to reach the maximum excursion level.

19. A method for protecting a loudspeaker, the method comprising:

receiving an audio input signal;

generating an excursion signal corresponding to a first excursion level of a voice coil of the loudspeaker based on the audio input signal;

limiting the excursion signal to reach a maximum excursion level;

determining a target pressure for an enclosure of the loudspeaker based on the maximum excursion level;

generating a target current signal based at least on the target pressure; and converting the target current signal into a target voltage signal to a target driving signal to drive the voice coil to reach the maximum excursion level.

20. The method of claim 19 further comprising applying a first filter to the maximum excursion level prior to determining the target pressure for the enclosure.

* * * * *